US009974711B2

(12) United States Patent
Leffler

(10) Patent No.: US 9,974,711 B2
(45) Date of Patent: May 22, 2018

(54) PORTION CONTROL MIXING CUP

(71) Applicant: Adam Calvin Leffler, Salt Lake City, UT (US)

(72) Inventor: Adam Calvin Leffler, Salt Lake City, UT (US)

(73) Assignee: Adam Leffler, Lake Elsinore, CA (US)

( * ) Notice: Subject to any disclaimer, the term of this patent is extended or adjusted under 35 U.S.C. 154(b) by 269 days.

(21) Appl. No.: 14/657,985

(22) Filed: Mar. 13, 2015

(65) Prior Publication Data

US 2016/0175196 A1 Jun. 23, 2016

Related U.S. Application Data

(60) Provisional application No. 61/953,400, filed on Mar. 14, 2014.

(51) Int. Cl.

| | |
|---|---|
| ***A61J 1/14*** | (2006.01) |
| ***A61J 7/00*** | (2006.01) |
| ***A61J 1/20*** | (2006.01) |

(52) U.S. Cl.

CPC ..... *A61J 7/0046* (2013.01); *A61J 1/2093* (2013.01); *A61J 1/2024* (2015.05)

(58) Field of Classification Search

CPC ..... A61J 1/1443; A61J 1/1418; A61J 1/1425; A61J 1/2093; A61J 1/2024; A61J 7/0046

USPC ..... 206/222, 209

See application file for complete search history.

(56) References Cited

U.S. PATENT DOCUMENTS

| | | | | |
|---|---|---|---|---|
| 4,779,722 A * | 10/1988 | Hall | A61J 1/2093 | 206/219 |
| 8,871,285 B2 * | 10/2014 | Markoulis | A47J 31/401 | 206/219 |
| 2009/0258115 A1 * | 10/2009 | Minfray | B65D 1/265 | 426/86 |

* cited by examiner

*Primary Examiner* — King M Chu

(57) ABSTRACT

Elements of the present invention relate to a portion control cup with multiple chambers for storing, mixing and dispensing substances. Some elements relate to a lower chamber with a removable seal and seal removal tab that can be removed through a slot in an upper chamber wall. Some elements relate to nesting characteristics of the portion control cup.

20 Claims, 3 Drawing Sheets

PORTION CONTROL MIXING CUP

CROSS-REFERENCE TO RELATED APPLICATIONS

This application claims the benefit of U.S. Provisional Application No. 61/953,400, filed Mar. 14, 2014.

BACKGROUND OF THE INVENTION

1. Field of the Invention

The present invention relates to a portion control container, and more particularly to a container for dispensing accurate portions while minimizing cross-contamination and loss of contents.

2. Background and Related Art

Current cups used in the medical field were not originally designed for the dispensing of medication and lack consideration for consistent measurement of mixing solution and potential cross contamination conditions. Alternatives do not allow for dual use of the cup.

Individuals and professionals attempting to mix whole or partially crushed medications with a mixing solution, such as pudding or applesauce, in current cup designs often use inconsistent amounts of mixing solution that can create unnecessary and excessive amounts of combined product that must be ingested by the individual or patient.

Current solutions also lack markings for proper fill levels of mixing solution which can result in insufficient amounts of mixing solution being mixed with whole or partially crushed medication. This can make ingesting the combined product difficult for an individual or patient to swallow. Furthermore, many current mixing solution cup options are stored openly and exposed to airborne contaminants. Additionally, storing current cups and mixing solution in a container separate from the actual mixing process can result in cross-contamination. Currently used cups in the administration of medications requiring a mixing solution are not designed to minimize cross-contamination or serve to safeguard consistent mixing solution dosing.

BRIEF SUMMARY OF THE INVENTION

Embodiments of the present invention comprise an apparatus for storing and mixing substances. Exemplary apparatus comprise a lower chamber base, a lower chamber wall with a bottom end connected to said base, wherein said lower chamber base and said lower chamber wall form a lower chamber. These embodiments further comprise a seal shelf with an inside edge connected to the top of said lower chamber wall, wherein the seal shelf is configured for receiving an inter-chamber seal. These embodiments further comprise an upper chamber wall with a bottom end connected to an outer edge of the seal shelf wherein the upper chamber wall comprises a slot for extraction of a seal. Embodiments further comprise a rim connected to a top of the upper chamber wall. Some embodiments further comprise an inter-chamber seal attached to the seal shelf wherein the inter-chamber seal comprises a seal removal tab configured to protrude through the slot in the upper chamber wall.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the present invention provide consistent dosing of mixing solution and reduction of cross-contamination exposure by providing multiple sections or chambers. In some embodiments, a first chamber may hold a pre-measured amount of a first content sealed for shelf stability while the second or upper chamber is either open for holding items like pills or sealed with a second seal or lid to retain a second content or to prevent contamination. An exemplary embodiment comprises a slot for removal of the first seal on the lower chamber.

Figure 1:
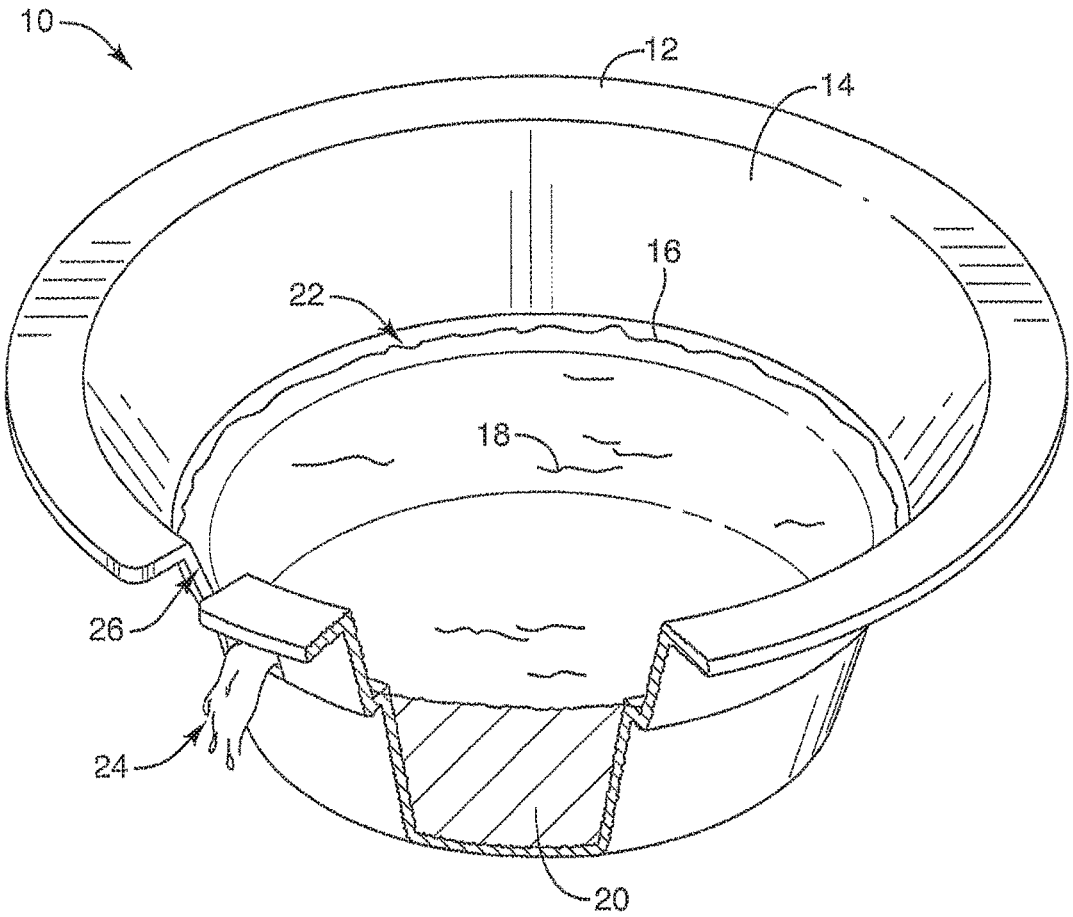
FIG. 1 shows a cutaway perspective view of an embodiment of the present invention.

Some embodiments of the present invention may be described in relation to FIG. 1. These embodiments comprise a mixing cup 10 with features that provide for sealed storage of a first content substance in a specific amount or dosage and a container for mixing the first content substance with other substances without transfer of the first content substance from its storage container. These embodiments may comprise a cup rim 12 which may be configured to accept a removable seal such as a cellophane membrane adhered to cup rim 12. Cup rim 12 may also be configured to receive a cup lid 15 such as with threads for a screw-on lid or with a lip to receive a snap-on lid.

Mixing cup 10 may further comprise an upper chamber wall 14, which defines the horizontal boundary of an upper chamber 21 for mixing, storing and dispensing substances. The base of the upper chamber wall 14 connects with an inter-chamber seal shelf 16. In some embodiments, inter-chamber seal shelf 16 may comprise a narrow horizontal surface for receiving a removable seal 22, such as a plastic membrane. Inter-chamber seal shelf 16 may also connect with a lower chamber wall 18, which defines the horizontal boundary of a lower chamber 11. Lower chamber wall 18 may extend from inter-chamber seal shelf 16 to a base 20.

Accordingly, a sealed lower chamber 11 may be contained by a base 20, a lower chamber wall 18, an inter-chamber seal shelf 16 and an inter-chamber seal 22, which is preferably, removably adhered to inter-chamber seal shelf 16 thereby sealing a lower chamber 11.

Mixing cup 10 may further comprise a slot 26 providing a break in cup rim 12 and upper chamber wall 14. Slot 26 may have a narrow gap width in practice or may have an interference fit such that its sides touch each other and prevent spillage of contents while being flexible enough to allow passage of a plastic film seal upon extraction of the seal. Accordingly, a plastic film or other form of flexible seal 22 having a removal tab 24 protruding from slot 26 may be removed, thereby unsealing a lower chamber 11, by pulling the seal 22 through slot 26 by manually pulling on removal tab 24. If slot 26 has a flexible interference fit, slot 26 may substantially close any gap after removal tab 24 and seal 22 are removed.

Figure 2:
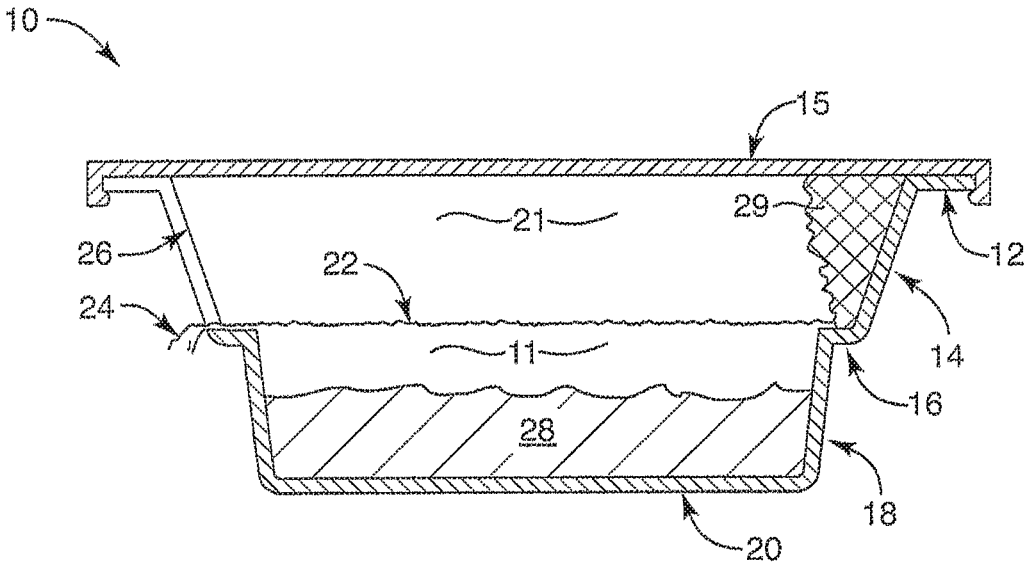
FIG. 2 shows a sectional view of an embodiment of the present invention with an inter-chamber seal.

Some embodiments of the present invention may be described with reference to FIG. 2. In practice, a first substance 29, such as a powder can be placed in upper chamber 21. Additionally, a second substance 28, such as a liquid can be sealed in lower chamber 11 with an inter-chamber seal 22. Presumably, first substance 29 and second substance 28 are such that a chemical reaction occurs upon mixing that renders the mixture perishable or, for some other reason, necessary to consume within a short time period. Consequently, first substance 29 and second substance 28 cannot be stored in a mixed condition.

When a user desires to consume the mixed substances, a user can tip cup 10 so that slot 26 is upward and the first substance 29 shifts to the side of the cup opposite slot 26 by the force of gravity. The user may then pull on removal tab 24 to extract inter-chamber seal 22 and allow first substance 29 to mix with second substance 28. The cup 10 may then be shaken or swirled to further mix the first and second substances 29, 28 within the upper chamber 21 and lower chamber 11. After mixing, the lid 15 can be removed and the mixed substances can be consumed.

Figure 3:
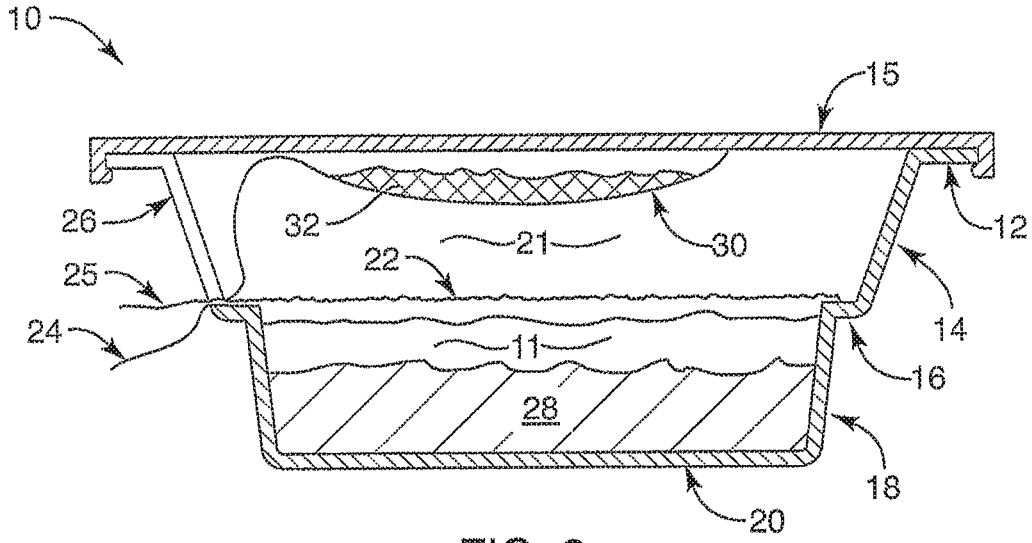
FIG. 3 shows a sectional view of an embodiment of the present invention with an inter-chamber seal and an upper content seal.
Figure 4:
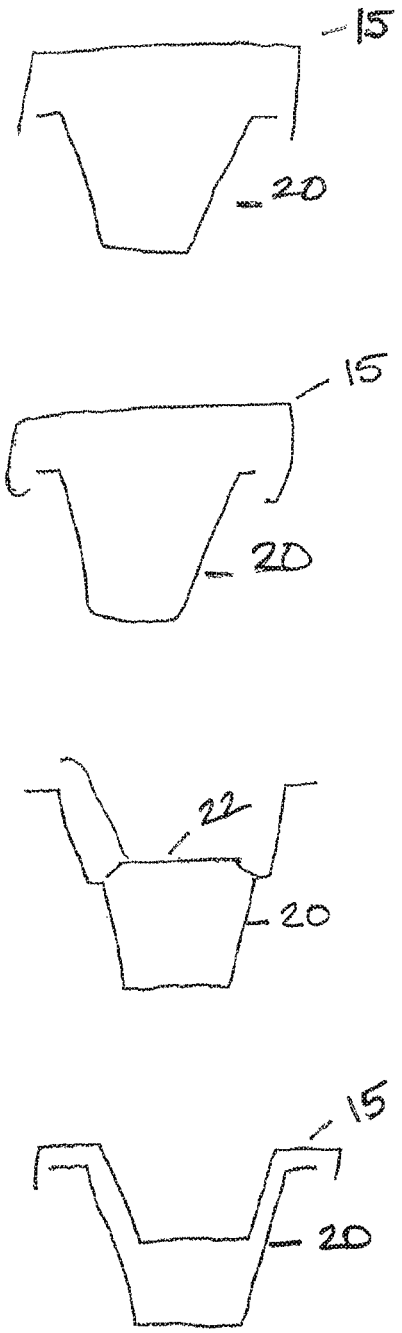
FIG. 4 shows a sectional view of various embodiments of the present invention of the inter-chamber seal, cup lid and base.
Figure 4:
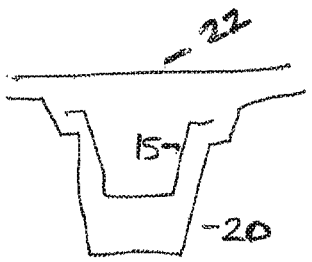

Some embodiments of the present invention may be described with reference to FIG. 3. In these embodiments, a substance may be sealed within an upper chamber by placing an upper seal or lid 15 across cup rim 12 and any open portion of slot 26. Accordingly, a first substance 28 may be sealed in a lower chamber and sealed with a first seal 22 and another substance 32 may be stored in an upper chamber and sealed with an upper content seal 30. The inter-chamber seal 22 between the chambers may be removed by pulling on removal tab 24 and the seal 22 may be extracted through slot 26. Likewise, upper content seal 30 may be removed by pulling on upper removal tab 25 and by extracting through slot 26. The substances may then be mixed by shaking or swirling the mixing cup 10 before the upper chamber seal or lid 15 is removed thereby confining the substances to the mixing cup 10. In this manner, the substances may be measured and stored in precise quantities and cross-contamination is minimized. The mixed substances may then be consumed after removing the upper seal or lid 15.

Embodiments of the present invention may store a pre-measured and consistent amount of mixing solution in a professional, facility-sealed lower chamber 11. These embodiments may also provide a separate upper chamber 21 where an individual, specific medicine can be stored before mixing. The separately sealed chambers 11, 21 prevent unnecessarily lengthy exposure of the mixing solution to the environment, thereby reducing exposure to airborne contaminants. The methods of embodiments of the present invention provide for the mixing of medications whereby the mixing takes place in the same cup where the mixing solution was professionally sealed before use. Therefore, there is a reduced likelihood for cross-contamination and a consistent amount for optimal mixing and medicinal delivery.

Embodiments of the present invention can be manufactured in a variety of ways using a plethora of materials. However, an exemplary embodiment may be molded from food grade plastic with slot 26 being molded in or cut out after molding. Alternatively, a thermoformer, high-tech 3D printer, or blow molding operation may be used.

While embodiments of the present invention may be made in almost any size and shape to accommodate many differing applications, in an exemplary embodiment cup base 20 is approximately 1.5 inches in diameter. The total cup height is between 1.5 and 2 inches high. The inter-chamber seal shelf 16 is approximately half the cup height between 0.75 and one inch above the base. The inter-chamber seal shelf is approximately ⅛ inch to ¼ inch wide. The bottom of the upper chamber is typically 1.75 inches in diameter while the top of the upper chamber is approximately 2.5 inches in diameter.

In some embodiments, there is a recessed ridge ⅛ inch below the top edge of the top chamber and that ridge may be ⅛ inch wide to accommodate manufacturing and possible nesting cups. In some embodiments, a slight protruding ring circles the lower chamber 0.5 inches from the base of the lower chamber to improve manufacturing process options.

The illustrated embodiments of the present invention comprise chamber walls 14, 18 that are tapered or funnel shaped in that their upper diameter exceeds their lower diameter. This conical, tapered or funnel shape. This shape can be configured to accommodate a nesting cup in the upper chamber when no lid is attached or a lid is configured in a similar shape. Further embodiments may comprise other shapes. Other embodiments may comprise an octagonal, hexagonal, elliptical, square or other shape.

In typical usage, a person could save time by using the present invention to replace multiple current products to achieve the same purpose. A person could reduce cross-contamination associated with additional transference of mixing solution from one container to another when the present invention already contains the solution in consistent pre-measured amounts. In an exemplary usage method, a user can simply place pills or other items in the upper chamber 21 and remove them when ready to crush or consume. Then remove the inter-chamber seal 22 covering the lower chamber 11, add in crushed pills or other consumables, mix, and then remove the entire mixture by spoon or other device.

Some embodiments of the present invention comprise markings molded, etched, painted or otherwise marked on the upper chamber wall to indicate the amount of a substance placed into the upper chamber. Using these markings, a user can place a specific measured amount of substance into the upper chamber for mixing with the previously measured amount of another substance in the lower chamber.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. An apparatus for storing and mixing substances, said apparatus comprising:

a lower chamber base;

a lower chamber wall with a bottom end connected to said base, wherein said lower chamber base and said lower chamber wall form a lower chamber;

a seal shelf with an inside edge connected to the top of said lower chamber wall said seal shelf for receiving an inter-chamber seal;

an upper chamber wall with a bottom end connected to an outer edge of said seal shelf said upper chamber wall comprising a slot for extraction of a seal; and a rim connected to a top of said upper chamber wall, said slot extending longitudinally and cut within said upper chamber wall.

2. The apparatus of claim 1 further comprising an inter-chamber seal attached to said seal shelf wherein said inter-chamber seal seals off said lower chamber from said upper chamber.

3. The apparatus of claim 2 wherein said inter-chamber seal comprises a seal removal tab oriented to protrude from said slot and facilitate extraction of said inter-chamber seal from said slot.

4. The apparatus of claim 1 wherein said rim comprises a lip for receiving a snap-on lid.

5. The apparatus of claim 1 wherein said rim comprises a threads for receiving a threaded lid.

6. The apparatus of claim 2 further comprising a substance stored in said lower chamber.

7. The apparatus of claim 1 wherein said upper chamber wall is tapered to form a funnel shape to allow nesting of another similarly shaped cup.

8. The apparatus of claim 1 wherein said apparatus is a monolithic molded shape.

9. The apparatus of claim 1 further comprising markings on said upper chamber wall to indicate amounts of substances placed therein.

10. An apparatus for storing and mixing substances, said apparatus comprising:

a lower chamber base comprising a round, flat surface;

a lower chamber wall tapered with a bottom dimension and a top dimension greater than said bottom dimension, said lower chamber wall having a bottom end connected to said lower chamber base, wherein said lower chamber base and said lower chamber wall form a lower chamber;

a seal shelf forming a horizontal surface with an inside edge connected to the top of said lower chamber wall said seal shelf for receiving an inter-chamber seal;

an upper chamber wall tapered with an upper wall bottom dimension and an upper wall top dimension greater than said upper wall bottom dimension, said upper chamber wall comprising a bottom end connected to an outer edge of said seal shelf said upper chamber wall comprising a slot for extraction of the inter-chamber seal; and a rim connected to a top of said upper chamber wall, said slot extending in said upper chamber wall and through said rim.

11. The apparatus of claim 10 further comprising an inter-chamber seal attached to said seal shelf wherein said inter-chamber seal separates said lower chamber from said upper chamber.

12. The apparatus of claim 11 wherein said inter-chamber seal comprises a seal removal tab oriented to protrude from said slot and facilitate extraction of said inter-chamber seal from said slot.

13. The apparatus of claim 10 wherein said rim comprises a lip for receiving a snap-on lid.

14. The apparatus of claim 10 wherein said rim comprises threads for receiving a threaded lid.

15. The apparatus of claim 11 further comprising a substance stored in said lower chamber.

16. A method for storing and dispensing a first substance, said method comprising:

storing a first substance in a lower chamber of an apparatus, said apparatus comprising, a lower chamber base;

a lower chamber wall with a bottom end connected to said base, wherein said lower chamber base and said lower chamber wall form a lower chamber;

a seal shelf with an inside edge connected to the top of said lower chamber wall said seal shelf for receiving an inter-chamber seal;

an upper chamber wall with a bottom end connected to an outer edge of said seal shelf said upper chamber wall comprising a slot for extraction of a seal;

an inter-chamber seal attached to said seal shelf, said inter-chamber seal comprising a seal removal tab protruding from said slot; and a rim connected to a top of said upper chamber wall, said slot extending in said upper chamber wall and through said rim;

wherein said first substance is sealed within said lower chamber by said inter-chamber seal.

17. The method of claim 16 wherein said rim further comprises a lip for receiving a lid and said apparatus comprises a lid attached to said rim.

18. The method of claim 16 wherein said rim further comprises rim threads for receiving a lid and said apparatus comprises a lid threaded to mate with said rim threads.

19. The method of claim 16 wherein said apparatus further comprises a lid connected to said rim, wherein said inter-chamber seal, said upper chamber wall and said lid define an upper chamber and wherein said method further comprises placing a second substance in said upper chamber.

20. The method of claim 19 further comprising pulling said seal removal tab and extracting said inter-chamber seal to facilitate mixing of said first substance and said second substance.

* * * * *